United States Patent [19]

Carter, III

[11] 4,397,469

[45] Aug. 9, 1983

[54] METHOD OF REDUCING PREDICTABILITY IN CARD GAMES

[76] Inventor: Bartus Carter, III, P.O. Box 22, Pomona, N.J. 08240

[21] Appl. No.: 404,393

[22] Filed: Aug. 2, 1982

[51] Int. Cl.[3] ..... A63F 1/00

[52] U.S. Cl. ..... 273/149 R; 273/292

[58] Field of Search ..... 273/148 A, 149 R, 292

[56] References Cited

PUBLICATIONS

Atlantic City Magazine, Jul. 1981, article entitled "Bart Carter: From Hustling Aces to Acing Hustlers".

Copy of Oral Presentation by Bart Carter in Nevada in Oct. 1981, entitled "Maintaining a Casino Advantage Against Card Counters".

*Primary Examiner*—Anton O. Oechsle

*Attorney, Agent, or Firm*—Bruce M. Collins

[57] ABSTRACT

A method for reducing predictability in card games such as blackjack and twenty-one in which play is periodically interrupted, played cards are shuffled, some or all of the shuffled played cards are divided into groups and the groups are returned to the stack of unplayed cards at predetermined positions.

14 Claims, No Drawings

METHOD OF REDUCING PREDICTABILITY IN CARD GAMES

This invention pertains to a method by which games of chance can be improved by reducing predictability.

Certain card games such as "blackjack" utilize a distinctive type of deal in which each round of play utilizes cards from a stack of unplayed cards which may consist of several decks. Played cards are collected after very round of play but are not immediately returned to play. Rather they are segregated and returned to play only after a substantial number of such played cards have been collected. As a result it is possible, by keeping track of the cards which have been played, to approximate the odds on the values of the remaining unplayed cards, giving rise to a variety of "counting systems" by which certain individuals can greatly increase their odds of winning.

With the advent of legalized gambling, casinos are faced with a delemma. On one hand, counting lowers the win rate by decreasing the number of hands dealt to non-counter customers and drains profits needed to justify the casino's substantial investment. On the other hand, efforts at detecting and barring counters are not only time consuming and expensive in the training and diversion of personnel but also potentially risky to the image of the casino should a good patron be barred on a mistaken suspicion that he is a counter. There is also a general feeling of unfairness in barring persons from an establishment otherwise open to the public simply because he or she is "too good".

Consequently, efforts have been directed at means by which the advantages of counters over other players can be minimized or at least diminished. Such means of combatting counters include special rules and mechanical devices but these must be designed to insure that they do not slow down the gam nor hurt the general player.

The present invention is based on a novel system of shuffling which reduced the predictability of unplayed cards, and thus the counter's advantage, without affecting the general player. Advantageously the system reduces overall shuffling time and provides for faster play.

According to the present invention, cards are dealt normally for each round of play from a stack of unplayed cards, contained for example in a conventional dealer's shoe. As is customary, a plurality of decks, each with identical backs, can be employed, typically but not necessarily, eight decks. Cards which have been played are not returned to the stack of unplayed cards after each round of play but are segregated, again as is customary. Ordinarily, play continues and the segregated played cards are shuffled with the remaining unplayed cards and returned for replay only after a cut card marker is reached. In the present invention, however, play is interrupted after a specified quantity of played cards has been accumulated.

It is important to bear in mind that by the very nature of the method, this and other quantities referred to herein are approximate and that the same are provided solely as guidance for those experienced in the skills of dealing.

The interruption in normal play discussed above will occur when the aggregate of played cards approximates or significantly exceeds a value of about n/d where n equals the total of all cards, played and unplayed, and d is an integer of from 2 to 20, preferably 3 to 10. The selection of d will depend somewhat on the number of cards in play. For example, with four decks of 52 cards each, n would equal 208 and, within the defined range of d, the value of n/d would correspond to from about 100 to 10. Utilization of the higher value of d renders the present system more effective but it generally slows down the gram if only a few decks are employed since the interruption would occur after only as few as about 10 cards have been played. Consequently, with fewer decks a lower value of d, providing a higher value of n/d, is desirable. On the other hand, if more decks are employed, utilization of a low value for d may result in too many cards being played prior to interruption of the game. With eight decks of 52 cards, for example, interruption would occur within the range of d when anywhere from about 200 to 20 cards have been played. Here a higher value of d is desirable. The value of d should thus be chosen so that the value of n/d is generally in the range of from 15 to 100 and as a general rule of thumb d can be selected so that its value is roughly the same as the number of decks in play.

It should be noted that calculation of when the aggregate number of played cards approximates n/d can be made prior to play, depending upon the number of cards to be used and the number of anticipated players, and a suitable indicia or marked placed on the discard rack. Alternatively, the value of n/d can be calculated and an estimate then made as to the number of rounds of play required to generate that number, the interruption thereafter being effected automatically after that number of rounds has been reached. For example with five players and eight decks, three rounds of play normally would produce about 50 to 60 played cards which would correspond to a value of 7 to 8 for d. For convenience therefore, interruption can be routinely effected after every three rounds. While the effective value of d then will depend on the number of players, fewer players will simply increase the effectiveness of the system.

When play is interrupted, the segregated played cards are thoroughly shuffled. (It should be noted that here and elsewhere thorough shuffling, as by the known "third/half" technique, is important).

In a first embodiment, some fraction, as for example approximately half, of the shuffled played cards are returned to the stack of unplayed cards, the other cards remaining in the discard rack. (To the cards so remaining will be added cards which are played subsequently after play is resumed).

In a second embodiment, all of the shuffled played cards are returned to the stack of unplayed cards.

In either case, the played cards to be returned to the stack are first divided into x groups, where x is an integer of at least 2, which groups can contain roughly equivalent numbers of cards or can contain nonequivalent numbers of cards. The value of x can vary but generally 3 or 4 groups, preferably 3, is entirely satisfactory. Higher values of x while rendering the method even more effective tend to unduly complicate and delay the game. Such groups can consist of as few as a single card but generally will contain more than one card.

The x groups of played cards are then returned to the stack of unplayed cards at designated areas. One group returned routinely is placed in the stack of unplayed cards at the point most distal to the unplayed card which was to be played prior to the interruption of play; i.e., at the bottom or rear of the stack, so that there is continuous movement of all cards. Each of the remaining groups is inserted at a different point within the stack, each of which point is removed from each other such point by at least one unplayed card and preferably a plurality of unplayed cards and which moreover is removed from that end of the stack containing the unplayed card which was to be played prior to the interruption; i.e. from the top or front of the stack. Generally but not necessarily these remaining groups $(x-1)$ will be placed in areas which, for convenience, can be designated the "front" area (the general area behind the front or top card), and "middle" area (the area between the "front" area and "back" card). If x is greater than 3, there of course would be several "middle" areas.

One convenient way to facilitate this phase of the method involves calculating the value of $[(n-n/d)/x]$ and utilizing the same to establish the areas. The points at which each group is to be inserted can be precalculated and appropriate indicia or markers then placed on the dealer's shoe. For example, utilizing eight decks of 52 cards, selecting d as 8 and x as 3, the value of $[(n-n/d)/x]$ is approximately 120. Consequently, markers would be placed on the dealer's shoe at points corresponding to 120, 240 and 360 cards. Since the last group (360) is necessarily placed after the back or bottom card, this point need not be marked. However, indicia on the shoe at 120 and 240 would mark the "front" and "middle" areas, respectively. The value utilized for placements of each group is approximate and some variation on each such placement not only is inevitable, it is desirable. Thus once the points are calculated and indicia are placed on the shoe, the dealer need only place each group in the stack in the general proximity of the indicia; e.g., ±about ½ inch.

Although one of the x number of groups is always placed at the back or bottom of the stack, it is not necessarily the first of the x groups. Indeed, as the x number of groups of shuffled played cards is being divided, each can be returned to the stack at an indicated area in any order.

When the groups have been reinserted in the stack, play is resumed until the conditions for interruption discussed above are met, whereupon the method is repeated.

It will be appreciated by those skilled in this art that many variations in my method are possible without departing from its basic elements of interrupting play, dividing part or all of the played cards into groups and returning these groups to different positions in the stack of unplayed cards. It is possible, for example, to initiate play with a portion of cards which while not technically played are nevertheless treated as segregated played cards. For example, a number of unplayed cards can be placed directly in a discard rack (following an initial conventional shuffle but prior to resumption of actual play). These cards will be shuffled with cards actually played and a part or all of these then returned to the stack upon practice of the present method in the manners described above. Moreover, as described above in connection with the first embodiment, each time play is interrupted and the cards in the discard rack are reshuffled, a fraction of the shuffled cards can be treated as "played cards" and replaced in the discard rack. Each round of play between deals thus can include treating cards which are not played as "played cards" by placing them in the discard rack prior to the initial play, or prior to the resumption of play after a shuffle, as the case may be.

In another variation, the stack can be divided into what is known as a double shoe with the method being practiced on alternating basis between each shoe. In still another variation, each of the x groups consists of only one or two cards each of which is inserted at a point in the stack similarly separated from other points by only one or two cards; i.e., weaving the played and unplayed cards in a style similar to that commonly employed in baccarat. In still another, d is selected so that the method is effected after each hand, requiring, of course, considerably more shuffling but greatly increasing the effectiveness of the method. Other minor variations and modifications, of course, are possible without departing from the spirit of this invention, which is defined solely by the appended claims.

What is claimed is:

1. The method of reducing the predictability in card games in which each successive round of play utilizes cards from a stack of unplayed cards while played cards are segregated and not returned to the stack after each round of play, which method comprises:

(a) interrupting play at such time as the aggregate of played cards approximates and prior to the time said aggregate significantly exceeds a value of about n/d, where n equals the total of all cards, played and unplayed, and d is an integer of from 2 to 20;

(b) shuffling said played cards;

(c) dividing at least some of said shuffled, played cards into x number of roughly equivalent or nonequivalent groups where x is an integer having a value of at least 2; and (d) returning one of said groups of cards to said stack of unplayed cards at the point most distal from the unplayed card which was to be played prior to said interruption of play and returning each of the remaining said groups to a different point in said stack of unplayed cards, each of said points being removed from the unplayed card which was to be played prior to said interruption of play, and being further removed from any other point at which another group is returned, by at least one card.

2. The method of claim 1 wherein d has a value of 4 to 10.

3. The method of claim 2 wherein only a portion of said shuffled played cards is divided as therein defined, the remainder being left as segregated, played cards to be combined with any played cards from subsequent rounds of play.

4. The method according to claim 3 wherein a first of the remaining groups of shuffled played cards is returned to a general front area of said stack behind the unplayed card which was to be played prior to said interruption, and the remaining group or groups are returned to areas intermediate thereto and to said most distal unplayed card.

5. The method of claim 3 wherein n has a value of 312, 364 or 416 and d has a value of 6, 7 or 8 respectively.

6. The method of claim 5 wherein x is 3.

7. The method of claim 6 wherein n has a value of 416 and d is 8.

8. The method of claim 2 wherein all of said shuffled played cards are divided into x groups and each of said group is returned to said stack of unplayed cards as therein defined.

9. The method according to claim 8 wherein a first of the remaining groups of shuffled played cards is returned to a general front area of said stack behind the unplayed card which was to be played prior to said interruption, and the remaining group or groups are returned to areas intermediate thereto and to said most distal unplayed card.

10. The method of claim 8 wherein n has a value of 312, 364 or 416 and d has a value of 6, 7 or 8 respectively.

11. The method of claim 10 wherein x is 3.

12. The method of claim 11 wherein n has a value of 416 and d is 8.

13. The method of claim 12 wherein the remaining two groups are returned to areas in said stack removed from said unplayed card by approximately one third and two thirds, respectively, of all of said unplayed cards.

14. The method of claim 1 wherein a number of unplayed cards are treated as played cards and divided with cards actually played as therein defined.

* * * * *